US008229141B1

(12) United States Patent
Benjamin

(10) Patent No.: US 8,229,141 B1
(45) Date of Patent: Jul. 24, 2012

(54) DENSE TRANSDUCER ARRAY AND METHOD

(75) Inventor: Kim C. Benjamin, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 247 days.

(21) Appl. No.: 12/844,290

(22) Filed: Jul. 27, 2010

(51) Int. Cl.
*H04R 25/00* (2006.01)

(52) U.S. Cl. ..... 381/182; 381/189; 381/190; 29/25.35; 29/594; 310/334; 310/340; 310/345; 310/348; 310/365; 310/366; 367/153; 367/155

(58) Field of Classification Search ..... 381/182, 381/189, 190; 29/25.35, 594; 310/334, 340, 310/345, 348, 365, 366; 367/153–156
See application file for complete search history.

(56) References Cited

U.S. PATENT DOCUMENTS 6,757,948 B2 * 7/2004 Ptchelintsev et al. ..... 29/25.35
* cited by examiner

*Primary Examiner* — Ramon Barrera
(74) *Attorney, Agent, or Firm* — James M. Kasischke; Michael P. Stanley; Jean-Paul A. Nasser

(57) ABSTRACT

A transducer array assembly includes a support structure having a plurality of predetermined openings therein for accommodating transducer components. Flexible circuits are embedded in the support structure. Each flexible circuit has first ends being positioned in the support structure predetermined openings. Terminal blocks are joined to the second ends. Transducer elements are positioned in the support structure predetermined openings and placed in electrical communication with the flexible circuit first ends. A polymer material is provided surrounding the transducer elements, said support structure, and said flexible circuit first ends. There is also provided a method for manufacturing the transducer array.

11 Claims, 6 Drawing Sheets

DENSE TRANSDUCER ARRAY AND METHOD

STATEMENT OF GOVERNMENT INTEREST

The invention described herein may be manufactured and used by or for the Government of the United States of America for governmental purposes without the payment of any royalties thereon or there for.

CROSS REFERENCE TO OTHER PATENT APPLICATIONS

None.

BACKGROUND OF THE INVENTION (1) Field of the Invention

The present invention relates to a dense transducer array that provides an acoustic transducer having relatively high operational bandwidth. More particularly, the present invention includes a cable harness component that efficiently provides and organizes numerous conductors within piezocomposite substrates to form transducer arrays with minimum impact on electro-acoustic performance.

(2) Description of the Prior Art

Several underwater sonar applications exist for high frequency wideband transducer arrays having individual elements such as described in U.S. Pat. No. 6,255,761 ('761) and herein incorporated by reference. In order to form and steer acoustic beams with an array of individual elements, the array elements must be spaced not more than one-half the acoustic wavelength at the highest frequency of interest. This implies, for square-shaped elements at least, that the elements' lateral dimensions are inversely proportional to frequency. Therefore, for fully populated radiating apertures, the number of elements increases exponentially as the spacing decreases.

As piezocomposite arrays, such as described in previously mentioned U.S. patent '761, move to higher operational bandwidths and frequencies, the element center to center spacing decreases as the number of elements forming the array aperture increases. The result is a need for a component that organizes the numerous electrical wires found in piezocomposite arrays.

U.S. patent '761 teaches that piezoceramic transducer arrays can be formed from a block of piezoceramic material. A piezoceramic transducer preform can be created by machining away material between preform posts and leaving a base portion of the piezoceramic material on a bottom side of the block and preform posts on a top side of the block. A generalized top surface is defined by the tops of the preform posts opposite from the surface defined by the base. Conductors are inserted in the gaps between the preform posts with the ends of the conductors extending through apertures formed in the base and beyond the general top surface of the preform posts. The combined base, preform post and conductor volume is filled with a liquid polymer which is allowed to harden. Any conductor or polymer extending above the general top surface is removed. The base and conductors extending beyond a selected transducer volume are removed leaving a bottom preform surface. Electrodes are provided on the top preform surface and the bottom preform surface. These electrodes can join with the conductor ends or can be connected to the conductor ends by known methods. This gives a flexible transducer array that can be used for a variety of applications.

SUMMARY OF THE INVENTION

Accordingly, it is an object of the present invention to provide a transducer array having densely packed transducer elements.

A second object is providing an array having mechanical isolation between array elements.

It is another object of the present invention to provide a transducer array that handles large numbers of conductors and distributes them in a two-dimensional lattice efficiently in a space-wise fashion.

A further object of the present invention is to provide a transducer array having mechanical isolation between array elements.

Furthermore, it is an object of the present invention to provide a transducer array that supports transmit operation as well as receive operation, while at the same time having cabling that is robust enough to handle high drive signals.

Yet another object is providing a transducer array having a plurality of closely spaced elements capable of transmitting and receiving acoustic signals at high frequencies.

Still another object is providing a method of making a transducer array having closely spaced transducer elements.

Other objects and advantages of the present invention will become more obvious hereinafter with regard to the disclosure contained in the specification and drawings.

Accordingly, there is provided a cable harness component that is particularly suited for transducer arrays. The cable harness component includes a support structure having a plurality of predetermined openings made from a viscoelastic material. A plurality of flexible circuits having conductors communicates between terminal blocks and electrical contacts within the support structure. Terminal blocks are positioned for outside electrical connection.

A cable harness component for a transducer array includes a support structure having a plurality of predetermined openings therein for accommodating transducer components. Flexible circuits are embedded in the support structure. Each flexible circuit has first ends being positioned in the support structure predetermined openings. Terminal blocks are joined to the second ends.

A transducer array assembly includes a support structure having a plurality of predetermined openings therein for accommodating transducer components. Flexible circuits are embedded in the support structure. Each flexible circuit has first ends being positioned in the support structure predetermined openings. Terminal blocks are joined to the second ends. Transducer elements are positioned in the support structure predetermined openings and placed in electrical communication with the flexible circuit first ends. A polymer material is provided surrounding the transducer elements, said support structure, and said flexible circuit first ends. There is also provided a method for manufacturing the transducer array.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
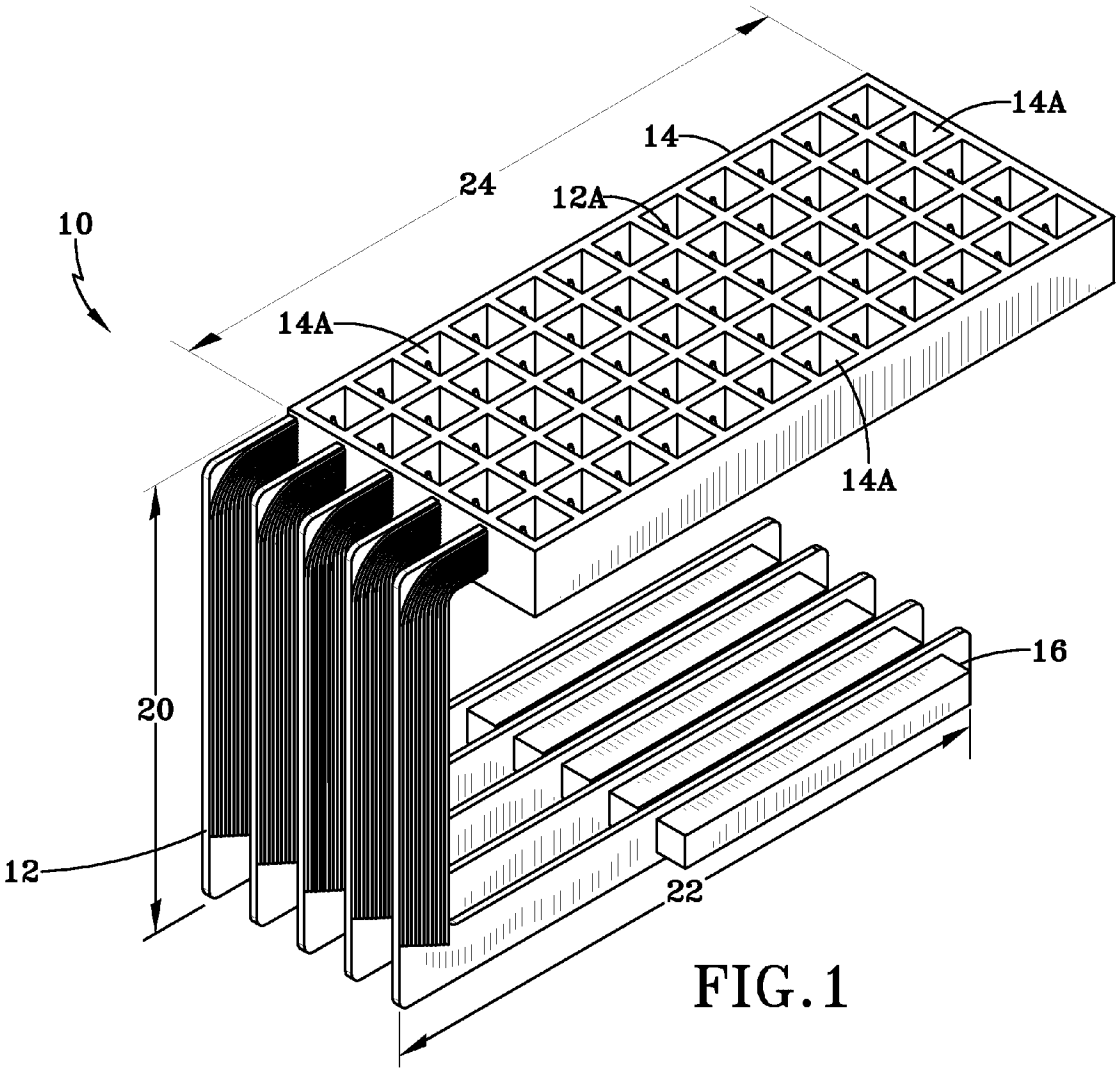
FIG. 1 is a side view of the cable harness component according to one embodiment of the present invention.

Referring now to the drawings, and more particularly to FIG. 1, there is shown the cable harness component 10 that includes a plurality of flexible circuits 12. Flexible circuits 12 are embedded within a support structure 14 and are terminated by conventional connector terminal blocks 16. The flexible circuits 12 have a plurality of flex-circuit ends that can connect the flexible circuits 12 to electrical contacts on the transducer material that is to be further described hereinafter with reference to FIG. 3. In FIG. 3, two specific flex-circuit ends are identified as 12A and 12B. The support structure 14 can be made of any material having the required vibration damping characteristics. Preferably, it is made of a viscoelastic material, known in the art. Support structure 14 has a plurality of openings 14A that will be further described with reference to FIG. 2.

In general, the cable harness component 10 comprises the support structure 14 having a plurality of predetermined openings 14A and comprised of a viscoelastic material. The plurality of flexible circuits 12 each have first and second opposite ends with each end having connecting means. The plurality of flexible circuits 12 are embedded in the support structure 14. The plurality of terminal blocks 16 each have first and second connecting means. The plurality of flexible circuits 12 and the plurality of terminal blocks 16 are preferably of an equal number and with the connecting means of the first opposite ends of the flexible circuits being connected to corresponding first connecting means of the terminal blocks 16. The second connecting means of the terminal blocks 16 are preferably made available for connecting to external equipment.

With reference to FIG. 1, it is seen that the cable harness component 10 has its support structure 14, its plurality of flexible circuits 12, and its terminal blocks 16 arranged in an opened three face assembly with the terminal blocks 16 and support structure 14 being arranged parallel to and facing each other and are spaced apart by about the horizontal height 20 of the flexible circuits 12.

The flexible circuits 12 are selected so as to have three sides with the first side having a length 22 to accommodate mating with the terminal blocks 16, the second side of the flexible circuits 12 has a length 24 to accommodate mating with the support structure 14, and the third side having a length so as to space apart the support structure 14 and terminal block 16 and corresponds to about the horizontal height 20 of the flexible circuits 12.

Figure 2:
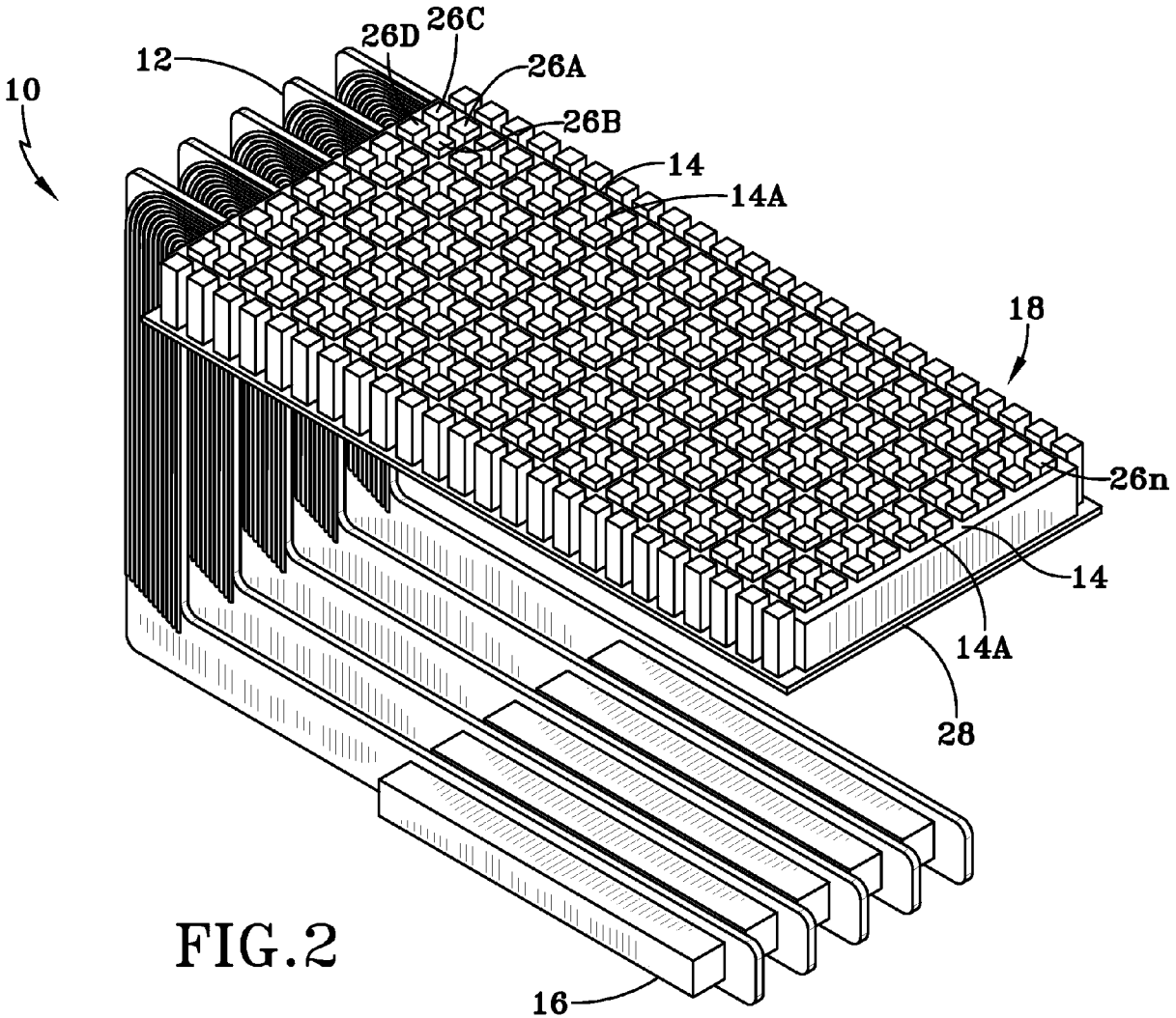
FIG. 2 is a top view illustrating the mating of the cable harness component with a transducer array.

With reference to FIG. 2, it is seen that the cable harness component 10 is particularly suited to be selected for mating with a transducer array. Transducer array can be formed from a preform 18 of piezoceramic material. This is more fully described above and in the previously incorporated by reference U.S. Pat. No. 6,255,761 ('761). The preform 18 comprises a plurality of posts 26A, 26B . . . 26*n* joined to a base 28. In this embodiment, four typical posts, 26A, 26B, 26C and 26D, are positioned in a single support structure opening 14A to form an array element. Each of the posts 26A . . . 26*n* represents an electromechanical unit. Openings 14A of the support structure 14 correspond and accommodate the insertion of one or more of the posts. Different embodiments of the invention can incorporate different numbers of posts. The number and lateral spacing of posts can be chosen according to the desired application.

The cable harness component 10 provides electrical connection for the posts 26, as well as electromechanical isolation, so that signals present in one portion of post or group of posts 26 do not affect another portion of posts 26. The interconnection of the cable harness component 10 to external equipment (not shown) may be accomplished via terminal blocks 16 which, in turn, are connected to appropriate cabling related to associated external equipment. The interconnection between the cable harness component 10 and the posts 26 may be further described with reference to FIG. 3A.

Figure 3A:
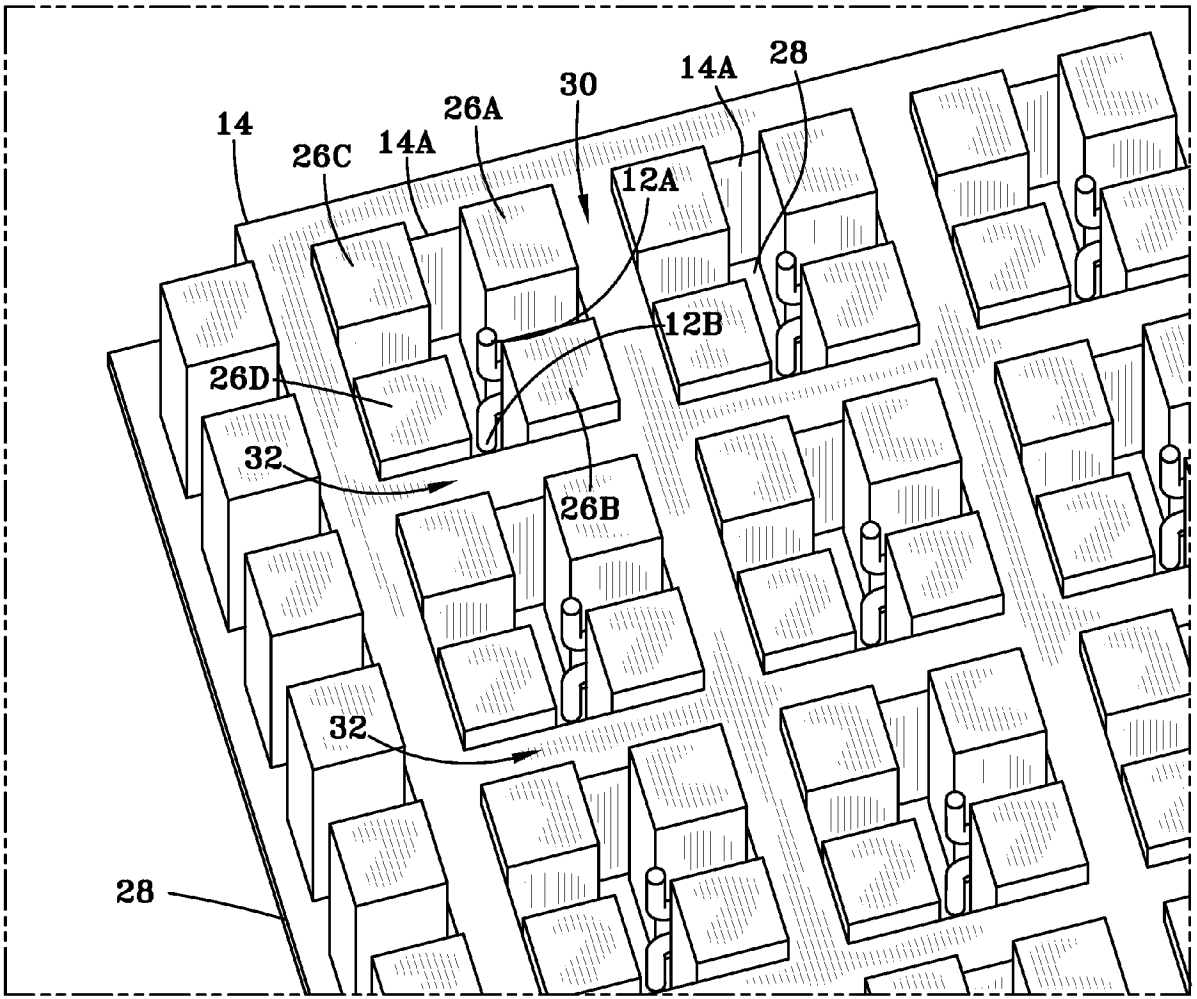
FIG. 3A is an expanded view of a portion of FIG. 2 before polymer has been added to the assembly.

FIG. 3A illustrates further details of the interconnections between the cable harness component 10 of FIG. 1 of the present invention and posts 26 of FIG. 2. More particularly, FIG. 3A is an expanded view of a portion of the interconnections between the cable harness component 10 and posts 26 for one typical embodiment of the present invention. Further, for the illustration of FIG. 3A, the flexible circuits 12 are not shown, but are present under and embedded within the support structure 14.

FIG. 3A illustrates a plurality of connecting means 12A and 12B. These are the ends of flexible circuit 12 conductors. In FIG. 3A directions are indicated by arrows 30 and 32. The flexible circuits 12 within the support structure 14, not shown in FIG. 3A, are arranged so as to run under the support structure 14, and are oriented along one direction 30 with like surfaces running parallel to each other. In direction 32 perpendicular to direction 30, the cable harness/isolator 10, in particular to support structure 14, does not have any embedded flexible circuits 12.

Ends of flexible circuit conductors, identified for one set as connections 12A and 12B are dimensioned and formed so that connection 12A exits out from the associated flexible circuit 12 upward and out of the associated chamber 14A, while connection 12B exits out from the associated flexible circuit 12 downward and out of the associated chamber 14A. The 12A connection located above the upper surface of the associated posts 26 is available for positive electrical connection to an associated electrode element, while the 12B connection located below the lower surface of the associated posts 26 is available for negative electrical or ground connection to an associated electrode element.

Cable harness 10 can be joined to a preform by the following method. Flexible circuits 12 are positioned within support structure 14 so that flexible circuit ends, as typically shown at 12A, are positioned to extend into an opening 14A. The other end of flexible circuit 12 is joined to an electrical connector 16. A ceramic array component, as detailed in U.S. patent '761, is available as a preform 18 having posts 26 joined to a base 28. Preform 18 is positioned within support structure 14 such that four posts 26 extend into each opening 14A. Of course, in other embodiments openings 14A can support different numbers of posts. Flexible circuit ends having a first electrical polarity 12A are positioned to extend out of each opening 14A, and flexible circuit ends having a second electrical polarity 12B are positioned to extend proximate the base 28 of the preform 18. In other embodiments, base 28 can have apertures formed therein for receiving flexible circuit ends 12B.

Figure 3B:
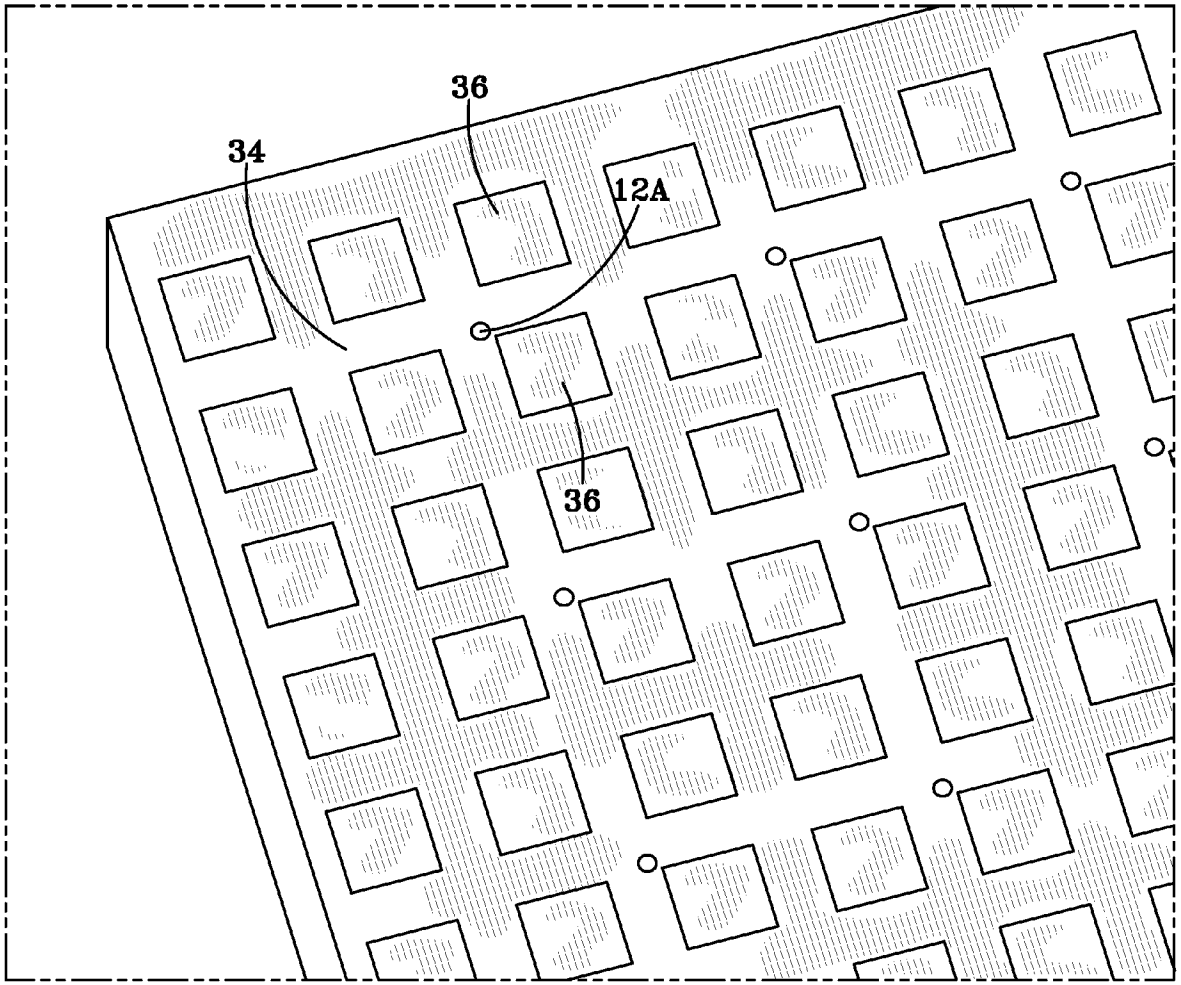
FIG. 3B is an expanded view of a portion of FIG. 2 after polymer has been added to the assembly, and the excess has been removed.

FIG. 3B shows the next step in creating a transducer array. A settable polymer 34 is provided around support structure 14 and within openings 14A to retain posts 26 and flexible circuit ends 12A and 12B in position within openings 14A and base apertures. After the settable polymer hardens, excess polymer 34, flexible circuit ends 12A and 12B and the ceramic array component base 28 are removed by machining. Upon removal of the polymer and base, a top surface and a bottom surface of the posts 26 are exposed. On the exposed surface shown in FIG. 3B, circuit end 12A is shown among post tops 36. Polymer 34 covers support structure 14. The bottom surface looks generally the same as the top surface.

Figure 3C:
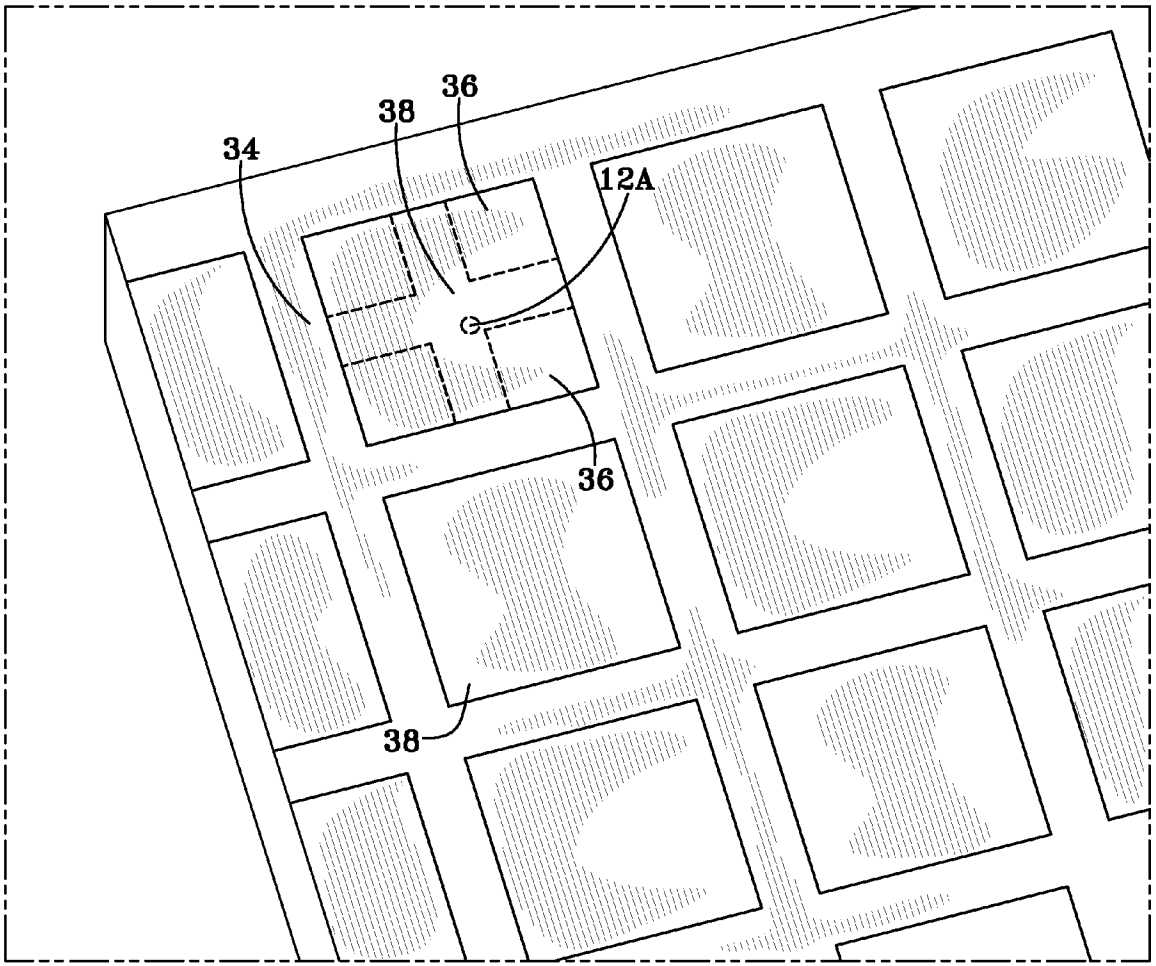
FIG. 3C is an expanded view of a portion of FIG. 2 after electrodes have been provided on the assembly.

As shown in FIG. 3C, electrodes 38 can be deposed on the top and bottom surfaces. Post tops 36 and circuit end 12A are shown with hidden lines. Electrode 38 electrically connects a selected number of post tops 36 with circuit end 12A. In this embodiment four post tops 36 are joined to a single circuit end 12A to form an array element. Electrodes 38 can be formed by providing a conductive coating on top of circuit ends 12A and post surfaces 36 by any number of methods known in the art. The conductive coating forms an electrode having a first polarity on post surfaces 36 and an electrode having a second polarity on the bottom of the posts (not shown). These electrodes 38 can be formed in contact with flexible circuit end such that flexible circuit end having a first electrical polarity is in electrical communication with the electrode having a first polarity on the top of the preform. Likewise, flexible circuit end having a second electrical polarity is in electrical communication with the electrode having a second polarity on the bottom of the post. As shown, multiple posts can be electrically joined by a single electrode to a single flexible circuit end. This process allows thermoforming the ceramic preform 18 substrate and organizes the numerous conductors making up the large number of array elements, such as the four posts 26, forming such an array element.

This can be performed by other methods such as by providing contacts on circuit sheets mounted to the top surface of array and to the bottom surface of array. A polymer coating can be provided outside the electrical components to shield them from the environment.

Figure 4:
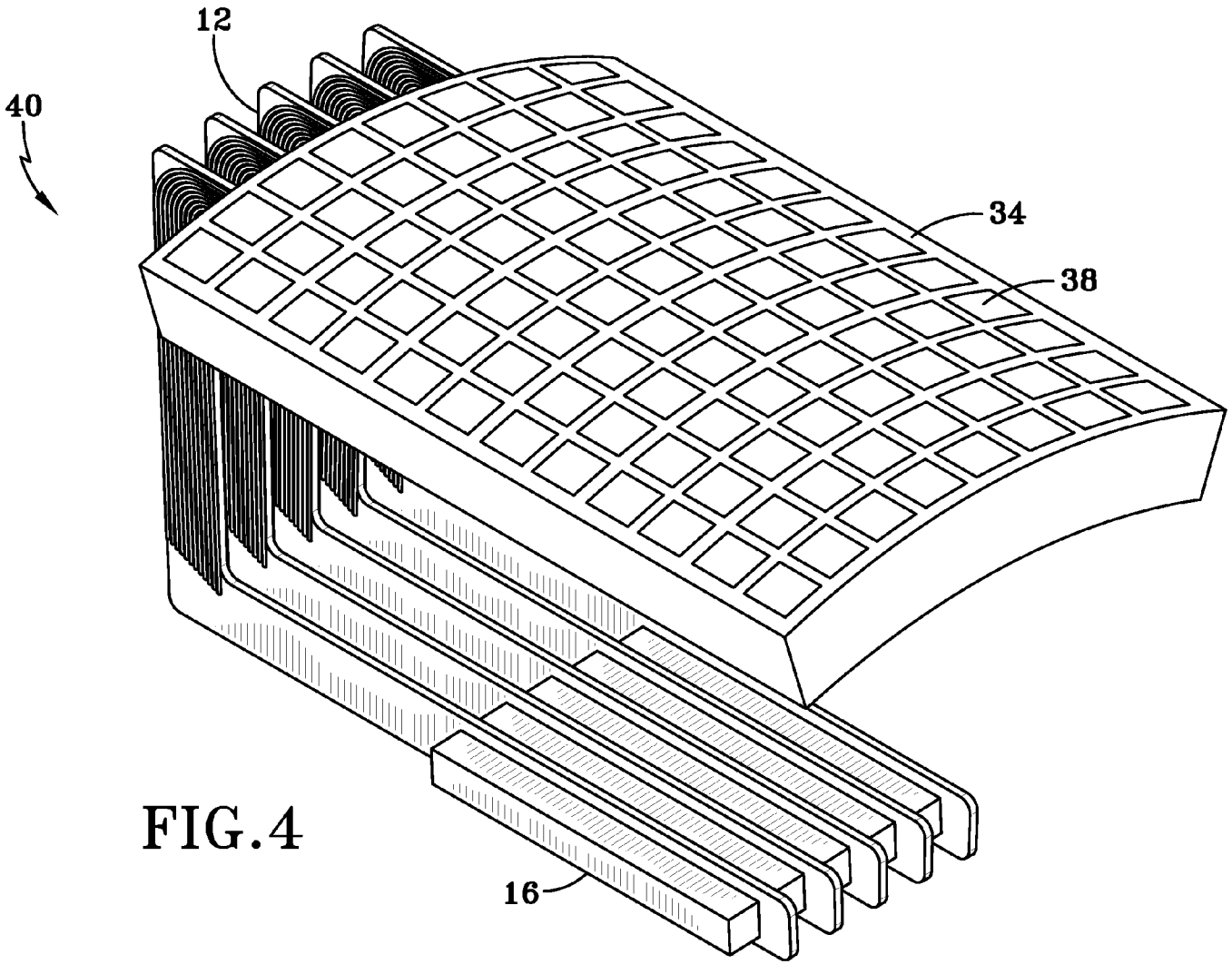
FIG. 4 illustrates a finished transducer array.

After the electrodes are formed, the array can be curved forming a finished transducer array 40, shown in FIG. 4. This array 40 includes a plurality of transducer elements indicated by electrode 38 embedded in a polymeric elastomer 34, known in the art. Array 40 can be prepared for use by covering it with an acoustically transparent coating and providing it on a resilient mounting. Flexible circuits 12 would likely extend into an interior of a structure.

It should now be appreciated that the practice of the present invention provides a cable harness/isolator 10 that can be used to form an array of acoustic transducer elements by installing it over a piezoelectric preform 18 that consists of individual ceramic posts 26, backfilling the formed substrate of arrays with polymer, and grinding the upper and lower surfaces of the substrate flat and parallel to each other.

It should be further appreciated that the practice of the present invention allows for handling a relatively large number of conductors entering the terminal blocks 16 and leaving the flexible circuits 12 so as to be, in one embodiment, distributed in a two-dimensional lattice efficiently in a spacewise fashion.

Further, it should be appreciated that the practice of the present invention provides mechanical isolation between array elements 26 deemed critical, by those skilled in the art, for wideband, high frequency grating-lobe free beam steering. The mechanical isolation is provided by the physical spacing between elements 26 and also the support structure 14 material.

Further still, it should be appreciated that the mated assembly comprising the cable harness component 10 and the PZT ceramic preform 18 supports transmit operation, as well as receive operation, while at the same time those skilled in the art may provide cabling made robust enough to handle high drive signals.

Still further, it should be appreciated that the practice of the present invention by those skilled in the art following the bending and curving principles of U.S. Pat. No. 6,255,761 and applying those principles to the embodiments described with reference to FIGS. 1-4 allows electrode substrate to be singly curved for conformal array fabrication.

It will be understood that many additional changes in the details, materials, steps and arrangement of parts, which have been herein described and illustrated in order to explain the nature of the invention, may be made by those skilled in the art within the principle and scope of the expressed in the appended claims.

What is claimed is:

1. A transducer array assembly comprising:

a support structure having a plurality of predetermined openings therein;

a plurality of flexible circuits embedded in said support structure, each flexible circuit having a plurality of first ends and second ends, said first ends being positioned in said support structure predetermined openings;

a plurality of terminal blocks joined to said flexible circuit second ends and having a connecting means;

a plurality of transducer elements wherein at least one transducer element is positioned in each support structure predetermined opening, said transducer elements being in electrical communication with said flexible circuit first ends; and a polymer material surrounding said plurality of transducer elements, said support structure, and said flexible circuit first ends for retaining said plurality of transducer elements in position with respect to said support structure.

2. The assembly of claim 1 wherein said support structure is made from a viscoelastic material that is capable of absorbing vibrations.

3. The assembly of claim 1 wherein:

each said flexible circuit first end comprises a first electrical polarity element and a second electrical polarity end element; and said transducer elements having a first end surface and a second end surface, said first end surface being in electrical communication with said first electrical polarity element, and said second end surface being in electrical communication with said second electrical polarity element.

4. The assembly of claim 3 further comprising a first electrode formed on said first end surface and a second electrode formed on said second end surface, said first electrode providing electrical communication between said first end surface and said first electrical polarity element, and said second electrode providing electrical communication between said second end surface and said second electrical polarity element.

5. The assembly of claim 4 wherein said first electrode is joined to multiple transducer elements.

6. A method for forming a transducer array assembly comprising the steps of:

providing a support structure having a plurality of predetermined openings therein;

providing a plurality of flexible circuits, each flexible circuit having a plurality of first ends and second ends;

positioning said flexible circuit in said support structure such that said flexible circuit first ends are in said support structure predetermined openings, each said flexible circuit first end having a first electrical polarity element and a second electrical polarity element;

attaching a terminal block to said flexible circuit second ends;

providing a transducer preform having a base and a plurality of preform posts joined to a first side of said base, said base having an opposite side away from said plurality of posts, and said preform posts each having a preform post top located away from said base first side and a preform post bottom joined to said base first side;

inserting said preform posts into said support structure predetermined openings, said transducer preform posts and said support structure defining a first plane;

positioning said plurality of first electrical polarity elements above said first plane;

positioning said plurality of second electrical polarity elements proximate said base;

filling said combined support structure, flexible circuit first end, and transducer preform with a liquid polymer whereby liquid polymer completely covers said first plane;

allowing said liquid polymer to set into hardened polymer;

removing hardened polymer from said first plane exposing said first electrical polarity ends and said preform post tops;

removing said transducer preform base whereby said second electrical polarity ends and said preform post bottoms are exposed;

electrically joining said preform post tops to said first electrical polarity ends; and electrically joining said preform post bottoms to said second electrical polarity ends.

7. The method of claim 6 wherein:

said base has a plurality of apertures arranged therethrough from said first side to said opposite side; and said step of positioning said plurality of second electrical polarity elements proximate said base comprises inserting said plurality of second electrical polarity elements in said base apertures to said opposite surface.

8. The method of claim 6 further comprising the step of coating the electrically joined preform post tops and first electrical polarity ends with a protective polymer.

9. The method of claim 8 further comprising the step of coating the electrically joined preform post bottoms and second electrical polarity ends with a protective polymer.

10. The method of claim 6 wherein the step of electrically joining said preform post tops to said first electrical polarity ends comprises forming a first electrode on said first plane between at least one preform post top and one said first electrical polarity end.

11. The method of claim 6 wherein the step of electrically joining said preform post bases to said second electrical polarity ends comprises forming a second electrode between at least one preform post bottom and one said second, electrical polarity end.

* * * * *